US007498495B1

(12) United States Patent
Mooers

(10) Patent No.: US 7,498,495 B1
(45) Date of Patent: Mar. 3, 2009

(54) HARP SOUND BOX CONSTRUCTION AND METHOD

(76) Inventor: Ray L. Mooers, 3450 - 16th Ave. West, Seattle, WA (US) 98119

( * ) Notice: Subject to any disclaimer, the term of this patent is extended or adjusted under 35 U.S.C. 154(b) by 112 days.

(21) Appl. No.: 11/038,595

(22) Filed: Jan. 18, 2005

(51) Int. Cl.
*G10D 1/04* (2006.01)

(52) U.S. Cl. ..... 84/265; 84/291

(58) Field of Classification Search ..... 84/265, 84/264, 275, 291, 174, 186.1; D17/14, 16
See application file for complete search history.

(56) References Cited

U.S. PATENT DOCUMENTS 1,392,053 A * 9/1921 Harrington ..... 84/285
1,426,852 A * 8/1922 Frozeth ..... 84/275
1,702,643 A * 2/1929 Claiborne ..... 84/264
1,817,951 A * 8/1931 Starke ..... 84/264
4,348,448 A * 9/1982 Cornell ..... 428/157
4,377,962 A * 3/1983 Parker ..... 84/269

* cited by examiner

*Primary Examiner*—Walter Benson
*Assistant Examiner*—Jianchun Qin
(74) *Attorney, Agent, or Firm*—Christensen O'Connor Johnson Kindness PLLC

(57) ABSTRACT

A soundbox (10) for a musical instrument including a panel (14) having an interior surface (22), two longitudinal edges (16) extending along the periphery of the panel (14), and upper (18) and lower (20) edges lateral to the longitudinal edges (16). The panel (14) also includes a plurality of longitudinal grooves (30 and 31) formed on the interior surface (22) of the panel (14) and of a depth extending along edges (16) and extending through a majority of the thickness of the panel (14). The panel (14) is foldable about the longitudinal grooves (30 and 31) to define a three-dimensional rectilinear shape forming the soundbox (10). A cap (52) is positioned at the upper edge (18) and a base (54) is positioned at the lower edge (20), and truss rods (64A and 64B) extend between the cap and base to assemble the components and increase the strength of the soundbox.

10 Claims, 10 Drawing Sheets

HARP SOUND BOX CONSTRUCTION AND METHOD

FIELD OF THE INVENTION

The present invention concerns a soundbox for a musical instrument, and more specifically a soundbox for a harp that is constructed from one foldable piece of material.

BACKGROUND OF THE INVENTION

The sound of a musical instrument can be enhanced through the use of a soundbox. A soundbox is a hollow box of a stringed instrument containing a soundboard. The instrument's strings attach to the soundboard, and the soundbox encloses the soundboard to form the hollow box of the instrument. The soundbox enhances the volume and tone of the instrument by acting as a resonator. It also enables the instrument to produce a clean, focused, natural sound.

Currently most soundboxes are made from at least one piece of wood. Use of wood, however, leads to increased manufacturing and assembly costs. The manufacturing process involves cutting, shaping, and finishing the wood. Moreover, wood can be a costly material, especially if a higher grade must be used. Assembly can also lead to increased costs. If the soundbox is made from several pieces, the pieces will have to be formed so that they fit securely together. Moreover, the separate pieces must be somehow joined together to form a durable, long-lasting soundbox. If the soundbox is formed from only one block of wood, on the other hand, the manufacturing process alone will lead to increased costs. The wood block would need to be formed and shaped such that it sufficiently forms a soundbox by itself. This would be a time-consuming effort that would likely necessitate the capabilities of skilled craftsmen.

Based on the foregoing, there exists a need for a soundbox that avoids the requirement of shaping, manufacturing, assembling, and finishing wood components. In other words, there is a demand for a low-cost soundbox made from inexpensive yet durable material that requires minimal manufacturing and assembly.

Soundboxes also have a tendency to deform over time due to the tension that the strings impart on the instrument. A soundbox is built such that it encloses a soundboard, and the soundboard is used to pull the strings tautly away from the instrument. By playing the instrument, the strings pull on the soundboard, and the soundboard and soundbox can deform over time. Accordingly, there is also a need to build a soundbox with a support or reinforcement to prevent deformation of the soundboard and soundbox.

SUMMARY OF THE INVENTION

One embodiment of a soundbox formed in accordance with the present invention includes a longitudinal panel that has an interior surface and an exterior surface, two longitudinal edges extending along the periphery of the board, and upper and lower edges lateral to the longitudinal edges of the panel. In addition, the panel has a plurality of longitudinal grooves formed on the interior surface of the panel that have a depth of a majority of the thickness of the panel. The panel may have at least one aperture extending from the interior surface to the exterior surface. The panel is foldable about the longitudinal grooves to configure the panel into a three-dimensional rectilinear shape forming the soundbox.

In another embodiment of the present invention, a soundbox assembly includes a three-dimensional rectilinear subassembly forming the rear wall and sidewalls of the soundbox assembly. The subassembly has an interior surface and an exterior surface and a plurality of grooves formed on the interior surface that extend longitudinally along the subassembly. The subassembly is foldable about the grooves to form the three-dimensional rectilinear shape of the subassembly. In addition, the subassembly may include at least one aperture. The assembly also includes a soundboard that spans between the free edges of the subassembly sidewalls to cooperatively form an enclosed soundbox assembly.

Yet another embodiment of the present invention is a method of forming and assembling a soundbox for a musical instrument. The method may include forming a plurality of grooves on an interior surface of the first member. The grooves extend from an upper edge of the first member to a lower edge of the first member but not through the exterior surface. The method further includes folding the first member along the plurality of grooves to form a subassembly generally U-shaped in cross-section comprising the distal and sidewalls of the soundbox. The method of assembly also includes positioning a soundboard to span between the two sidewalls.

An additional embodiment of the present invention includes a method of manufacturing and assembling a soundbox for a musical instrument. The method includes cutting a panel into a general frustro triangular shape, machining a plurality of substantially straight longitudinal grooves on an interior surface of the board of a depth comporting to a majority of the thickness of the board, wherein the grooves may radially diverge along the length of the board to generally comport with the frustro triangular shape of the board.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
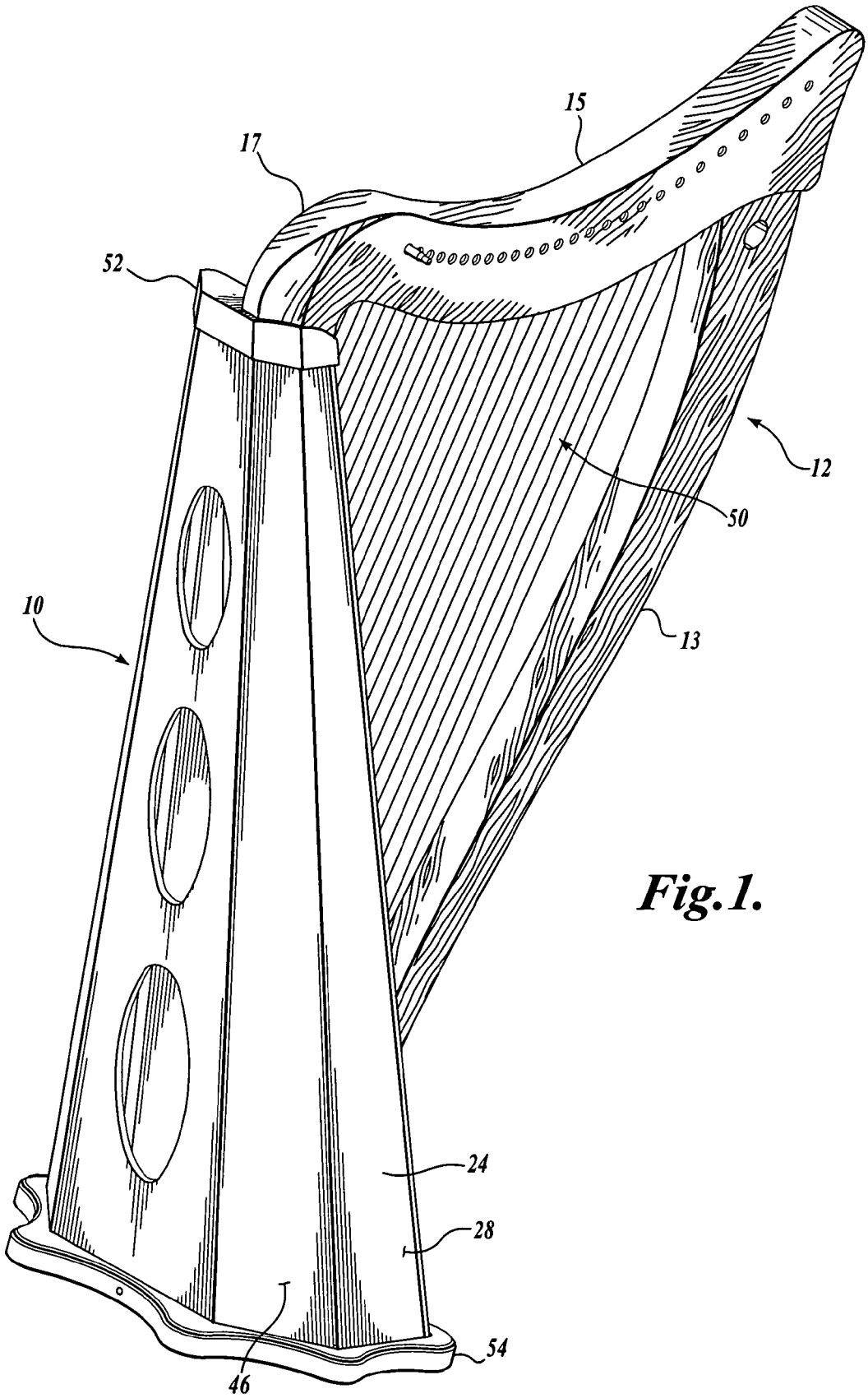
FIG. 1 is a rear perspective view of a soundbox secured to a harp.
Figure 2:
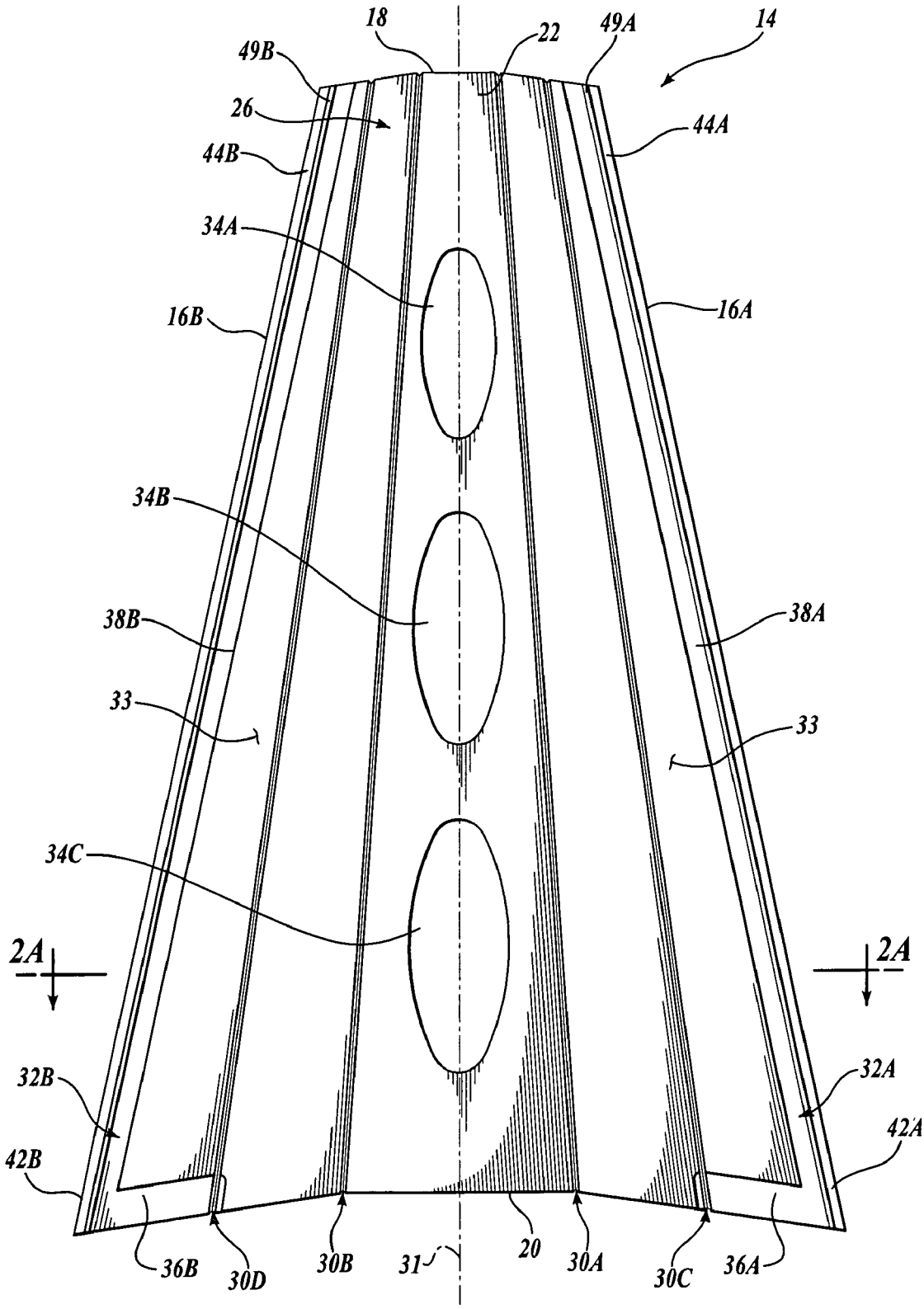
FIG. 2 is a perspective view of the interior surface of the unfolded soundbox depicted in FIG. 1.
Figure 3:
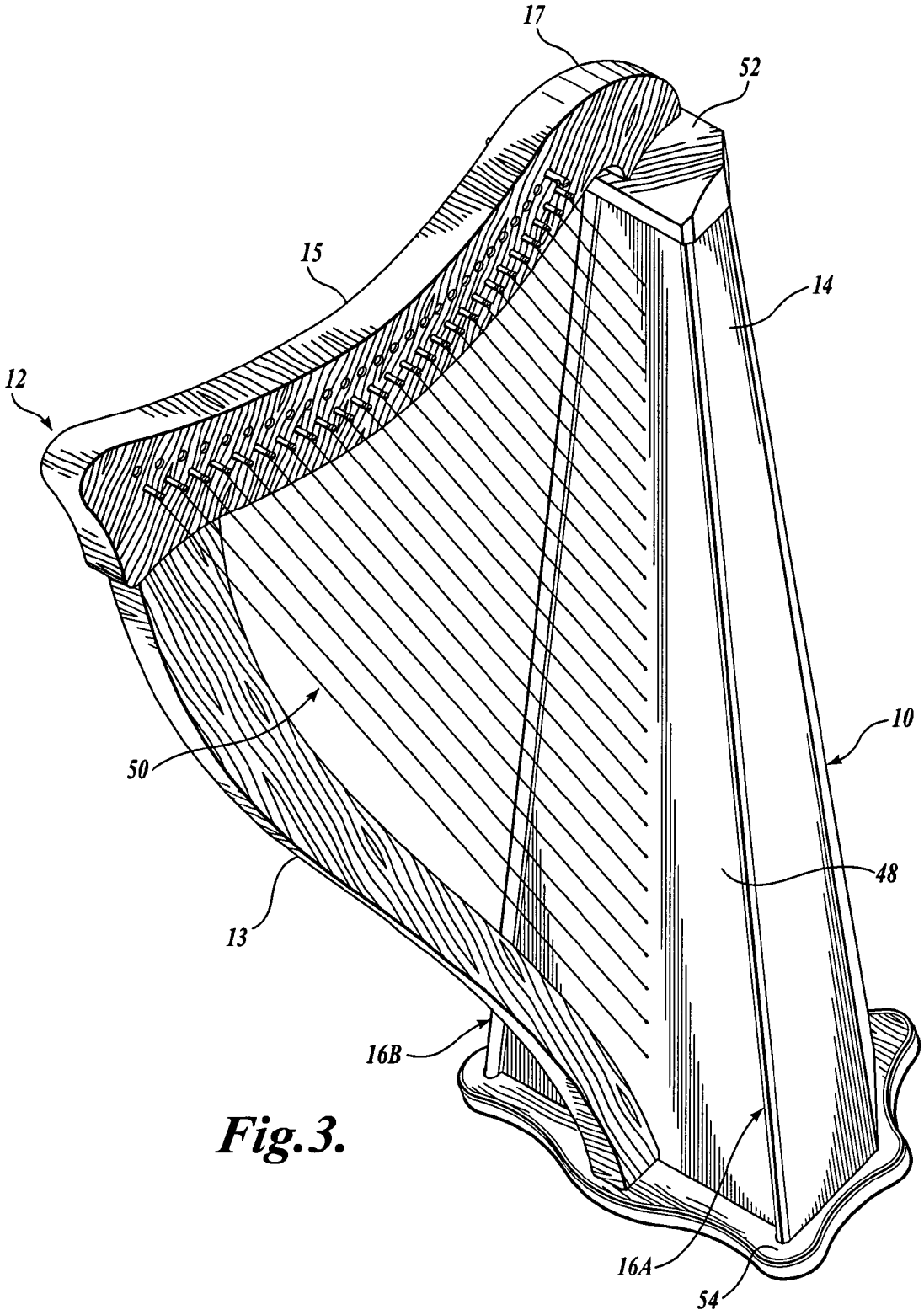
FIG. 3 is a front perspective view of the soundbox secured to a harp as depicted in FIG. 1, wherein a soundboard is disposed between the longitudinal edges of the soundbox.

Referring to FIGS. 1 through 3, the present invention relates to a soundbox 10 formed for a musical instrument. The soundbox 10 functions to enhance the musical quality of the instrument. A similar type of soundbox could be used for other stringed instruments; however, the present embodiment will be described as in conjunction with a harp. Referring to FIG. 1, the soundbox 10 is an element of a harp 12. The harp 12 includes a base 54, from which the soundbox 10 vertically extends. The soundbox 10 encloses a soundboard 48. Also extending upwardly and outward from the base 54 is a pillar 13. A harmonic curve or neck 15, which is continuous with a shoulder 17, joins the soundbox 10 to the pillar 13 at the top of the harp. A set of strings 50 extends in tension between the neck 15 and the soundboard 48. The strings 50 pull the neck 15 downward against the pillar 13 and help secure the harp 12 components to one another.

Referring specifically to FIG. 2, the soundbox 10 may be formed from a single longitudinal panel 14. For ease of illustration and clarity, the longitudinal panel 14 is shown in a substantially vertical orientation, although it may be suitably shown in any orientation, such as horizontal. Therefore, the terminology "vertical", "horizontal", "upper", "lower", "top", "bottom", etc., should be construed as descriptive and not limiting.

The panel 14 is preferably composed of a plywood; however, it can be appreciated that other materials such as medium density fiberboard may be used. Plywood is a less expensive alternative to solid wood, yet it is also easy to machine, has high strength, and is durable. Thus, an advantage of the present invention is that a high quality soundbox 10 can be fabricated from a lower cost material, such as plywood.

The panel 14 has two longitudinal edges 16A and 16B that extend along the peripheral sides of the panel. An upper edge 18 and a lower edge 20 of the panel 14 are lateral to both longitudinal side edges 16A and 16B. The panel 14 may be greater in width along the lower edge 20. Moreover, the panel 14 may gradually increase in width between the upper edge 18 and the lower edge 20. The shape of the panel 14 can be cut from a larger piece of material through the use of a saw or other similar cutting device.

The exterior surface of the board is overlaid by an exterior skin 28. The exterior skin 28 may be composed of a flexible vinyl material or other suitable material that may also provide protection and support. The skin material may consist of a flexible laminate, a plastic coating, or any other material that could adhere to and cover the surface of the panel.

Figure 2A:
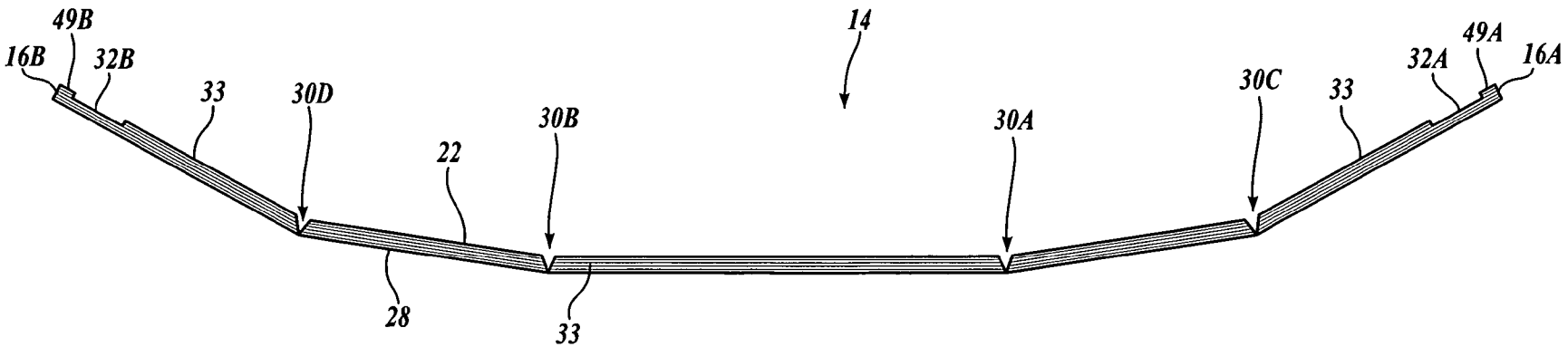
FIG. 2A is a cross-sectional view of FIG. 2, taken substantially along lines 2A-2A thereof.

Now referring to FIG. 2A, a plurality of longitudinal grooves 30A, 30B, 30C, and 30D extend along the length of the panel 14 to divide the board into longitudinal segments 33. A suitable machining tool can be used to form the grooves 30A, 30B, 30C, and 30D. The grooves 30A, 30B, 30C, and 30D are machined such that they are generally V-shaped in cross-section and have a depth extending through a majority of the thickness of the panel 14. The grooves 30A, 30B, 30C, and 30D may be formed through the use of a V-groove router or another tool familiar in the art. The grooves 30A, 30B, 30C, and 30D penetrate the interior surface of the panel 14, but they do not penetrate the exterior skin 28. Thus, the grooves 30A, 30B, 30C, and 30D separate the panel 14 into rectilinear sections. The exterior skin 28, however, can secure the sections to one another so that the panel 14 remains as one piece. The V-shape and the depth of the grooves 30A, 30B, 30C, and 30D allow the panel 14 to fold inward along the grooves 30A, 30B, 30C, and 30D to form a frustro triangular shape as shown in FIGS. 1 and 3.

Referring to FIGS. 2 and 2A, two pairs of V-shaped grooves 30A and 30B, and 30C and 30D are shown. However, fewer grooves or more grooves may be employed if a musician desires a differently shaped soundbox. The paired grooves 30A and 30B and 30C and 30D are symmetrical about a center vertical axis 31 of the panel 14. The symmetry of the V-shaped pairs of grooves 30A and 30B and 30C and 30D allows the longitudinal panel 14 to be folded into a symmetrically-shaped soundbox 10. However, it can be appreciated that non-symmetrical grooves may also be used if a musician prefers a soundbox 10 of another shape. Although the paired grooves 30A and 30B and 30C and 30D may be symmetrical about the central vertical axis 31, they are not parallel to one another. More specifically, the grooves 30A and 30B and 30C and 30D extend away from the center vertical axis 31 of the longitudinal panel 14 in a downward diagonal fashion, such that the grooves 30A and 30B and 30C 30D are closer in planar distance to the center vertical axis 31 at the upper edge 18 than at the lower edge 20.

The panel 14 may contain at least one aperture 34 extending through the panel. The aperture 34 also passes through the panel and the exterior skin 28. The aperture 34 may be centered between the first pair of longitudinal V-shaped grooves 30A and 30B. In the embodiment of the present invention shown in FIG. 2, three apertures 34A, 34B, and 34C are formed in the panel 14. Each aperture 34A, 34B, and 34C is centered between the first pair of longitudinal V-shaped grooves 30A and 30B. The apertures 34A, 34B, and 34C are illustrated as elliptical in shape; however, they differ in size. The size of the opening of aperture 34A may be slightly smaller than the opening of aperture 34B, and the size of the opening of aperture 34B may be slightly smaller than the opening of aperture 34C. It can be appreciated that fewer or more apertures may be formed, the arrangement may differ, and the apertures may differ in size and shape depending on the preferences of the manufacturer or the musician.

FIGS. 2 and 2A also depict one pair of longitudinal shallow grooves 32A and 32B, that are formed on the interior surface 22 of the panel 14 proximate to and extending along the longitudinal edges 16A and 16B. The grooves 32A and 32B are preferably symmetrical about the vertical center axis 31 of the panel 14. The surfaces of the grooves 32A and 32B are disposed in cross-section parallel to the interior surface of the panel 14. In other words, the grooves 32A and 32B are not V-shaped in cross-section like the longitudinal grooves 30A, 30B, 30C, and 30D. The grooves 32A and 32B include horizontal extension portions 36A and 36B at the lower edge 20 and longitudinal portions 38A and 38B along the panel side edges 16A and 16B. The grooves 32A and 32B can be formed with a straight plunge router bit; however, other methods may be utilized. The function of grooves 38A and 38B is to receive and position linings 61 as discussed below, and the function of groove extensions 36A and 36B is to receive and position base blocks 74A and 74B as discussed below.

The panel 14 may be folded along the V-shaped grooves 30A, 30B, 30C, and 30D. The resulting rectilinear shape, together with the soundboard 48, form the soundbox 10, which attaches to the neck assembly to form a complete instrument. The shape of the soundbox 10 provides advantages to the user. The user or musician sits behind the soundbox 10, such that he or she reaches around the soundbox 10 to play the harp 12. By using at least two pairs of symmetrical V-shaped grooves 30A, 30B, 30C, and 30D, the soundbox 10 will have beveled corners 46 rather than squared corners. Thus, the musician will be able to better access the strings 50 while reaching around the soundbox 10. Moreover, the beveled corners 46 provide greater comfort to a musician, since a musician does not have to lean his or her body and arms against square corners in order to reach the strings 50; rather, a musician may comfortably lean against beveled corners 46.

It can be appreciated, however, that a soundbox might be constructed using a fewer or greater number of edges depending on the preferences of the manufacturer or musician.

Now referring to FIG. 3, a soundboard 48 is shown interposed between the two longitudinal board member peripheral edges 16A and 16B. A cap 52 encloses the top opening in the soundbox, and a base 54 is used to both close the opening in the bottom of the soundbox 10 and provide stability and a foundation for the harp 12. The soundboard 48, cap 52, and base 54 may be made from either a solid wood or a plywood; however, other materials commonly known in the art may also be used, for example, resin composites, fiberglass, carbon graphite. The soundboard is needed to relay the harp strings 50 to the soundbox 10, such that the soundbox may amplify the vibrations from the strings. The soundboard 48 completes the soundbox to produce better resonance, volume, and clarity.

Figure 4:
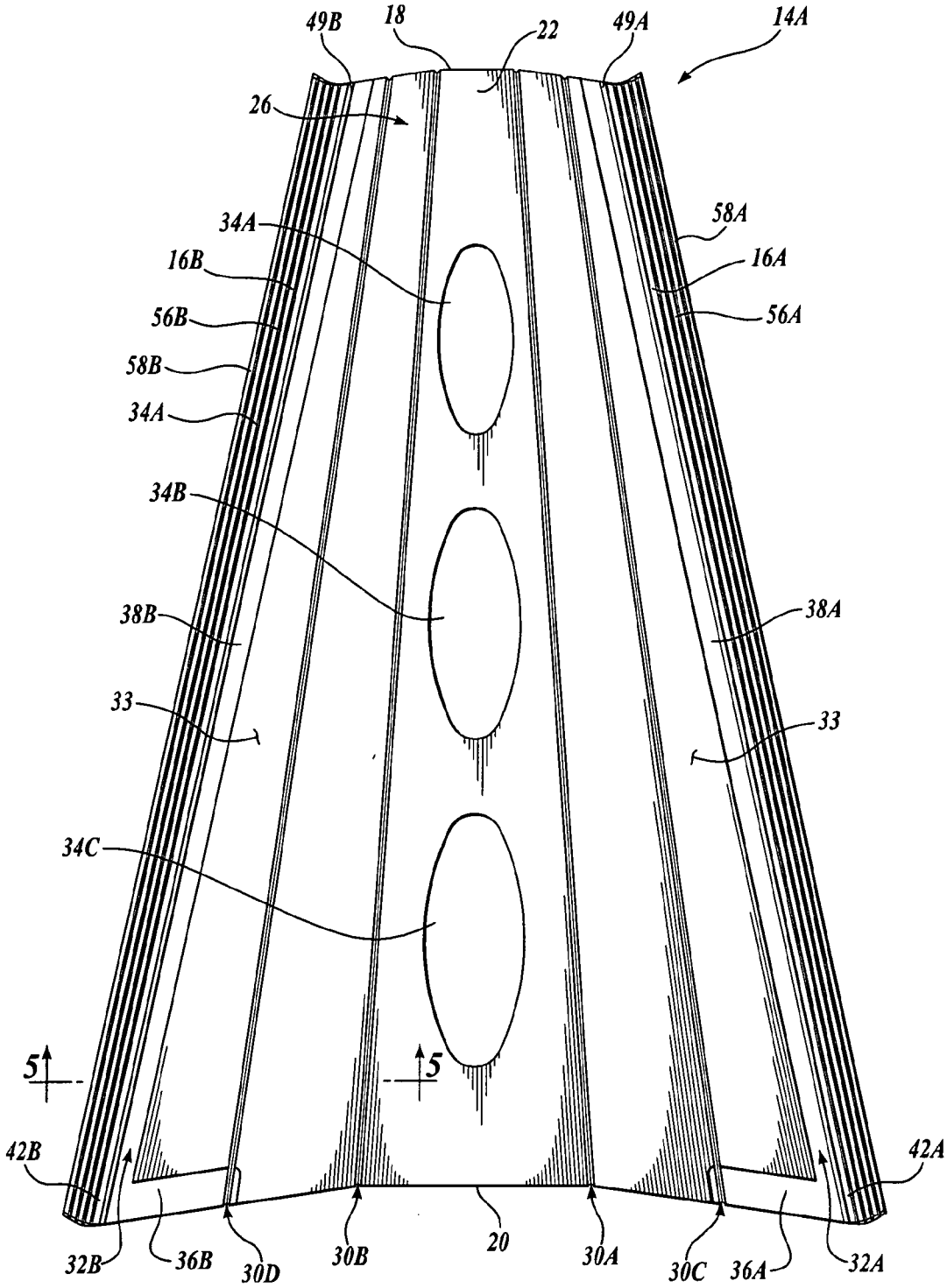
FIG. 4 is a perspective view of an alternate embodiment formed in accordance with the present invention of the unfolded soundbox depicted in FIG. 2, wherein a plurality of grooves are formed at the longitudinal edges of the unfolded soundbox.
Figure 5:
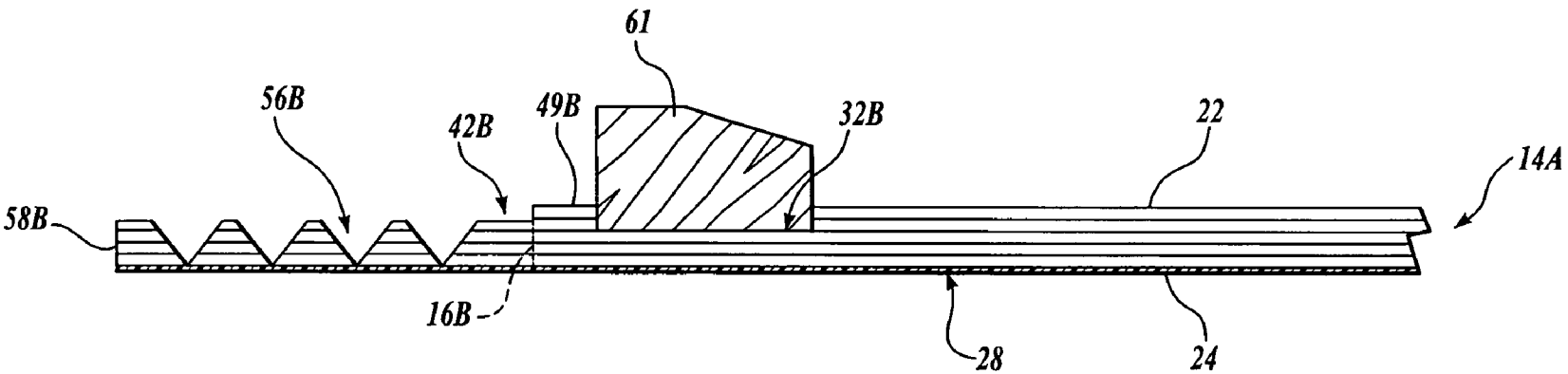
FIG. 5 is an enlarged cross-section of the unfolded soundbox edge depicted in FIG. 4.
Figure 6:
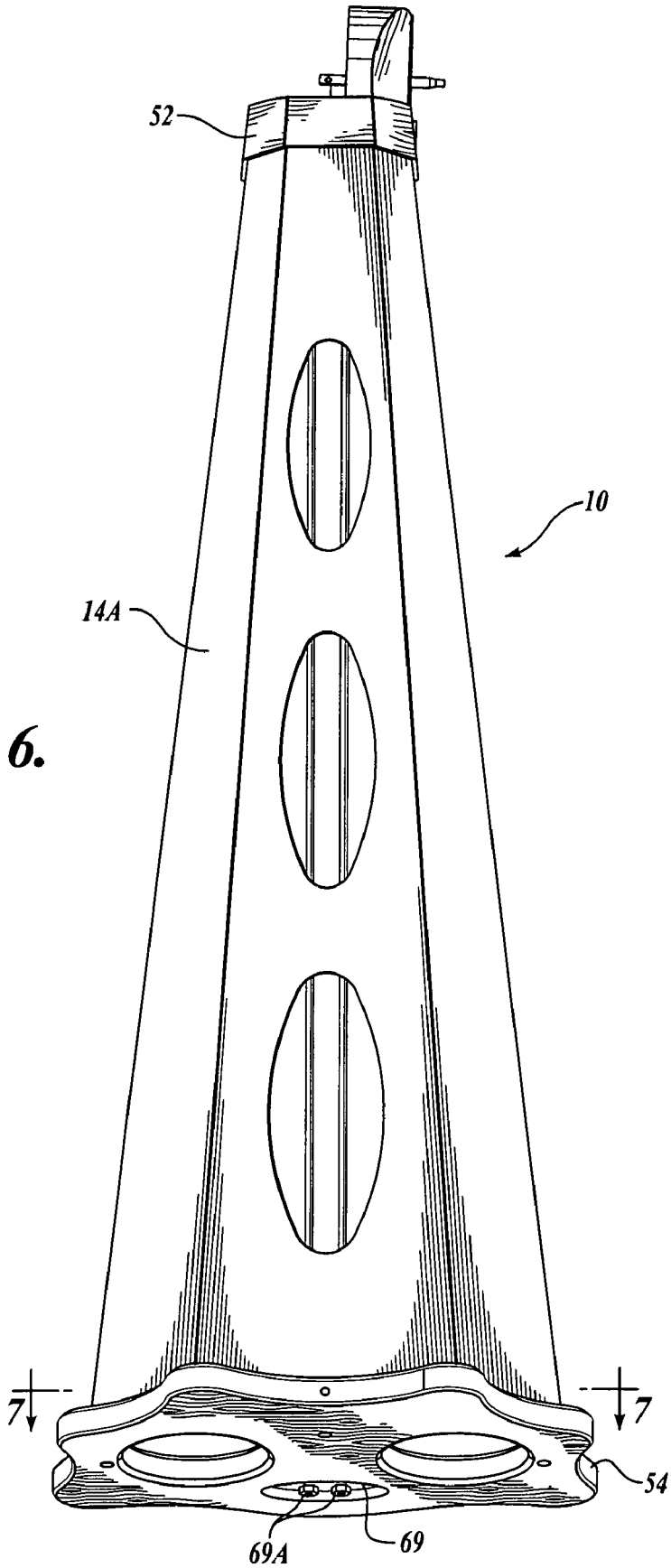
FIG. 6 is a perspective view of the alternate embodiment of the soundbox shown in FIG. 4 secured to a harp.

FIGS. 4 through 7 depict a panel 14A showing an alternative embodiment of the longitudinal edges 16A and 16B from that shown in FIG. 2A. Rather than the panel 14A terminating at the longitudinal edges 16A and 16B, the panel is extended to include two sets of a plurality of grooves 56A and 56B and extended, outer edges 58A and 58B. As shown in FIG. 5, the plurality of grooves 56A and 56B are machined or otherwise formed such that they are generally V-shaped in cross-section and have a depth comporting to a majority of the thickness of the panel 14A. Accordingly, the grooves 56A and 56B penetrate the interior surface 22, but they do not penetrate the exterior skin 28. The exterior skin 28 secures the sets of the plurality of grooves 56A and 56B to one another so that the panel 14A remains a unitary structure. Similar to the V-shaped grooves 30A, 30B, 30C, and 30D, the plurality of grooves 56A and 56B may be formed through the use of a V-groove router.

Referring to FIG. 4, one pair of longitudinal shallow, flat grooves 42A and 42B are outward to the L-shaped grooves 32A and 32B. Accordingly, groove 42A is formed between the longitudinal edge 58A and the L-shaped groove 32A. Similarly, groove 42B is formed between the longitudinal edge 58B and the L-shaped groove 32B. Grooves 42A and 42B extend from the lower edge 20 to the upper edge 18. The grooves 42A and 42B also define interior surfaces that are parallel to the interior surface 22 of the panel 14A. Similar to the L-shaped grooves 32A and 32B, the longitudinal grooves 42A and 42B can be formed with a straight plunge router bit.

Figure 7:
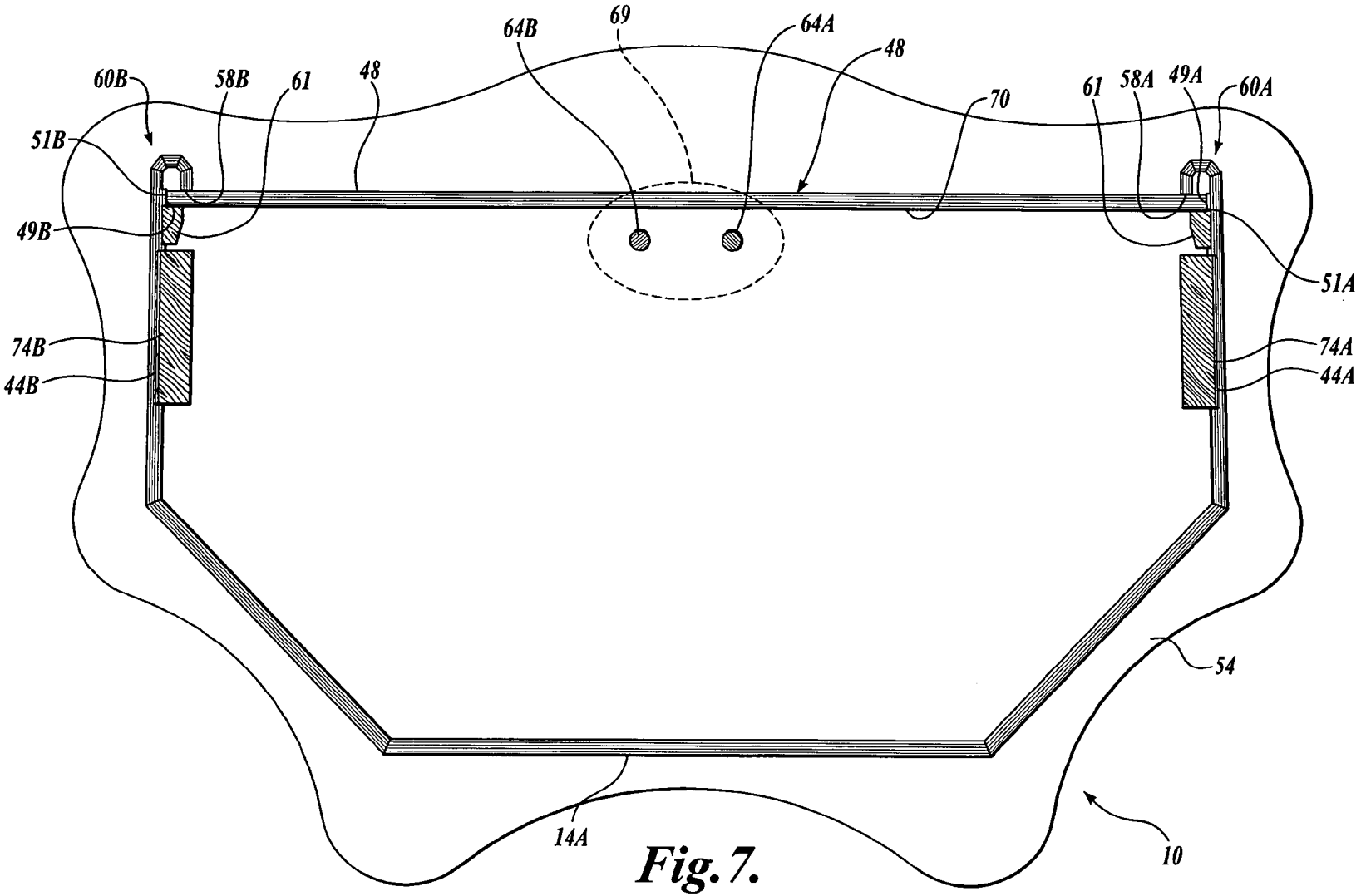
FIG. 7 is an enlarged cross-sectional view taken through Section 7-7 of FIG. 6 depicting the rolled edge of the soundbox enclosing the soundboard.

Now referring to FIG. 7, the panel 14A is shown as folded along the plurality of grooves 56A and 56B to form the soundbox 10 with soundboard 48. As shown in FIGS. 5 and 7, the V-shape and the depth of the grooves 56A and 56B allow the panel 14A to fold inward along the plurality of grooves 56A and 56B to form rolled edges 60A and 60B. The longitudinal grooves 42A and 42B provide a clearance so that the rolled edges 60A and 60B may be properly formed by folding inward along the plurality of grooves 56A and 56B. A glue or other adhesive may be interposed within the plurality of grooves 56A and 56B so that the rolled edges 60A and 60B maintain their form. The rolled edges, 60A and 60B, create a cosmetic continuity of the outer skin and provide a comfortable rounded edge for the hand. The rolled edges may also help secure the soundboard 48 to the soundbox 10.

As shown in FIGS. 5 and 7, the side edges 51A and 51B of the soundboard 48 abut sections 49A and 49B of the panel 14A, and is glued thereto. Also, a lining 61 is positioned within grooves 32A and 32B to abut against the interior surface 70 of the soundboard 48. The soundboard 48 may be glued or otherwise joined to the lining. The rolled edges 60A and 60B of the panel 14A are formed such that the outer edges 58A and 58B thereof are preferably parallel and abutting the outer surface of the soundboard 48.

Figure 8:
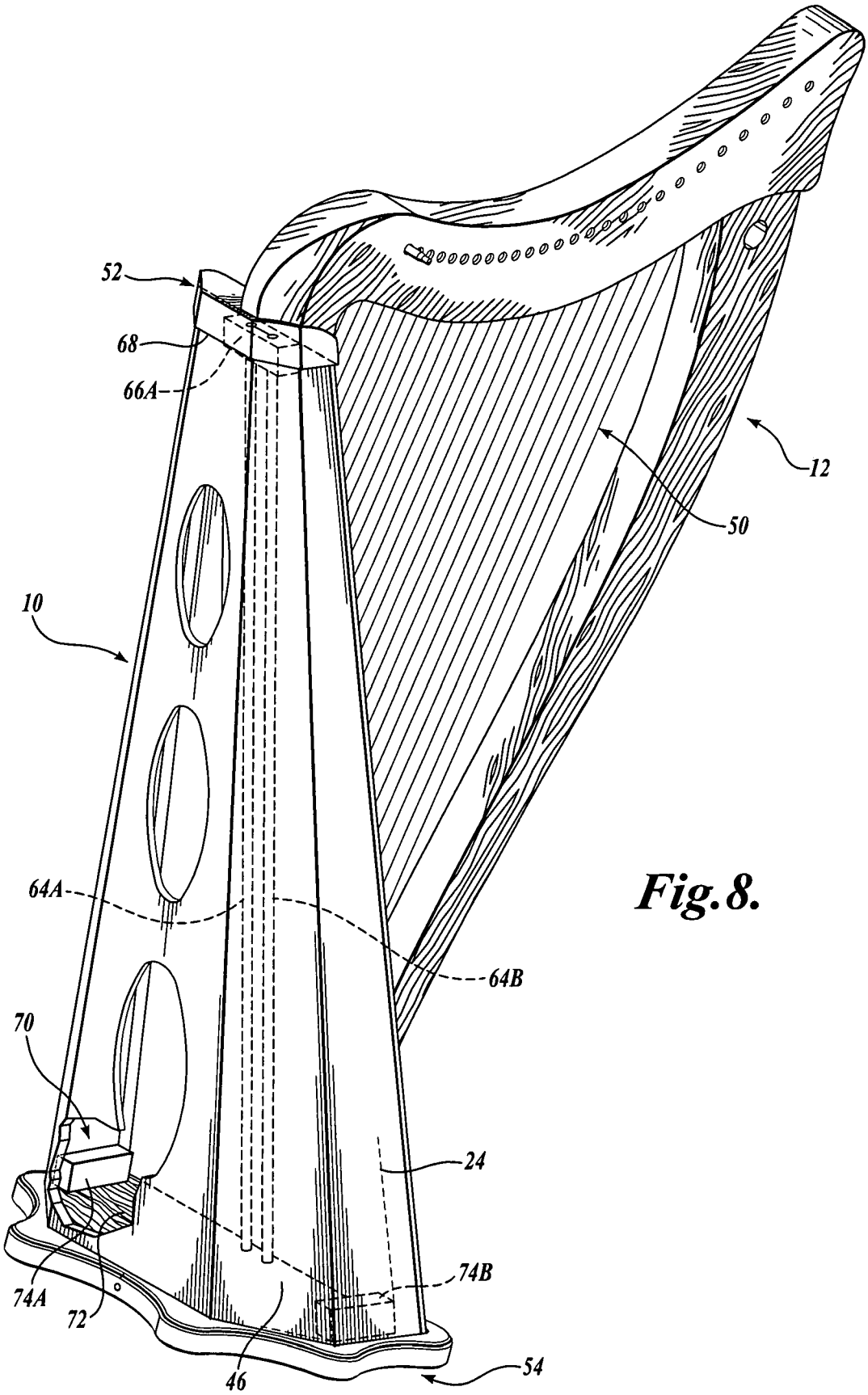
FIG. 8 is a partially broken-out sectional view of the rear of the soundbox shown in FIG. 1, wherein a system for reinforcing the soundbox is shown.
Figure 9:
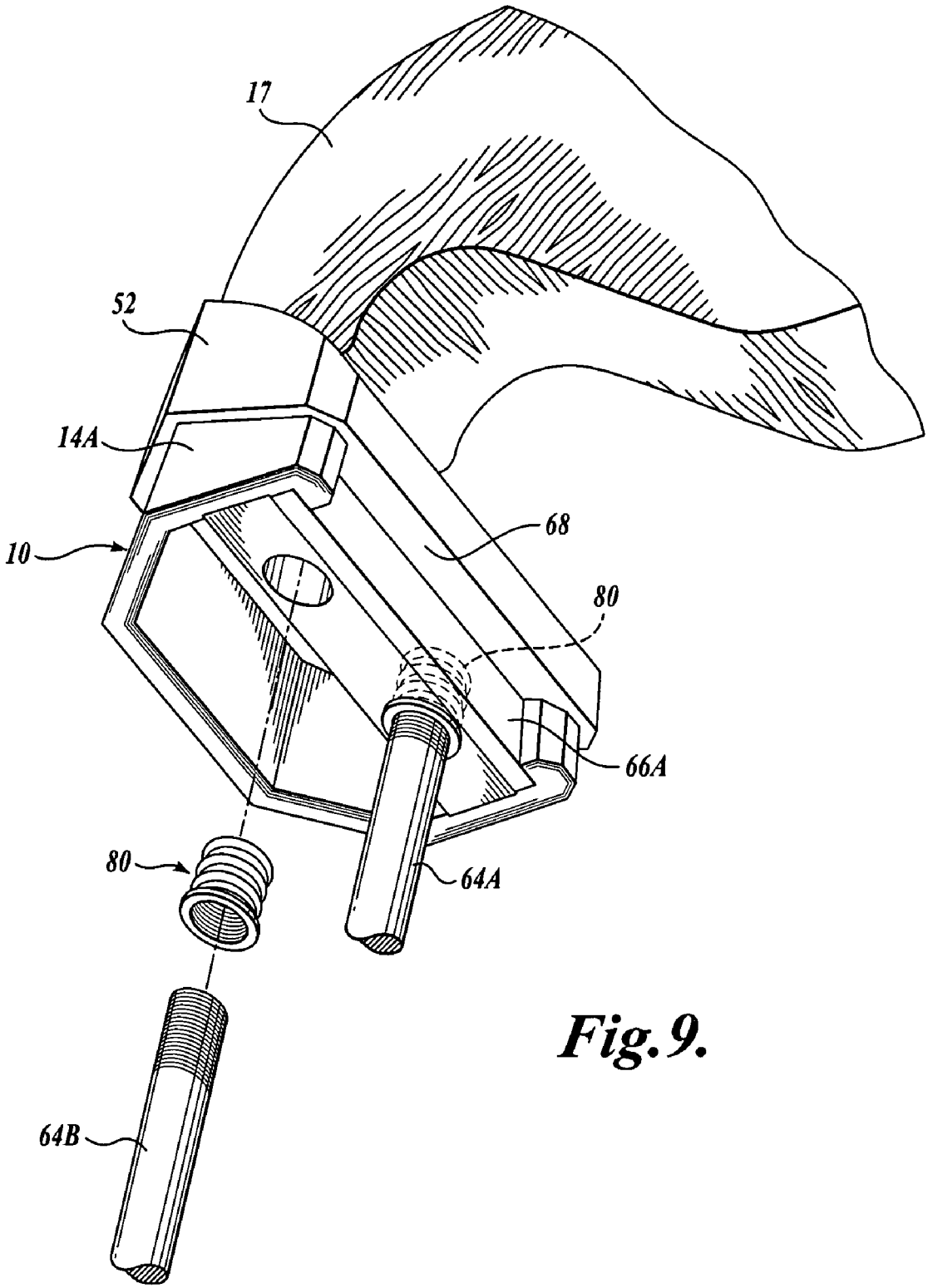
FIG. 9 is an exploded view of a portion of the system for reinforcing the soundbox of FIG. 8.

Referring to FIG. 8, a broken-out sectional view of the back of the soundbox 10 is shown. When the panel 14 or 14A is folded to form the soundbox 10, the soundbox 10 is enclosed by the base 54, the cap 52, and the soundboard 48. To help prevent deformation of the soundbox and base, longitudinal truss rods 64A and 64B may be secured within the enclosed area of the soundbox 10. The rods 64A and 64B extend between cap 52 and a base 54. An upper mounting block 66A may be secured to the interior surface of the cap 68, at a position adjacent to the interior surface 70 of the soundboard. The upper mounting block 66A may be secured to the cap 52 with fasteners, such as nails or screws, or an adhesive, such as glue. The upper mounting block 66A may also be secured to the soundboard 48 through an adhesive, such as glue. Referring to FIG. 9, the truss rods 64A, 64B may be anchored to the upper mounting block 66A with a fastener, such as a threaded insert 80, screw, or otherwise. Rather than using an upper mounting block 66A, the upper ends of the truss rods may engage threaded inserts mounted directly within the cap. Another mode of attachment of the upper ends of the truss rods could be that they pass through the cap and engage the neck 15 through threaded inserts mounted directly within the neck or some other suitable attachment method with the neck.

The lower ends of the truss rods may pass through holes formed in the base 54 and through holes formed in a reinforcing plate or truss plate 69 which bears against the bottom face of the base 54. A depression can be formed in the bottom of the base to recess the truss plate into the bottom of the base. The truss rods may anchor to the truss plate with fasteners, such as nuts 69A. The truss plate could be made of metal, such as steel or aluminum, dense plastic, or other suitable material.

Both truss rods 64A and 64B may be anchored such that they do not engage the soundboard 48. Clearance is provided between the rods 64A and 64B and the interior surface 70 of the soundboard. Both truss rods 64A and 64B are preferably made from a mild steel material, but other materials may also be used. The mounting block 66A may be made of wood, for example, mahogany, plastic, or other suitable material.

The truss rods 64A and 64B are advantageously utilized to assemble the components of harp 12, including cap 52, soundbox 10, base 54, neck 15, and pillar 13. This eliminates the need to utilize glue, screws, nails, or other types of fasteners to assemble the harp. Conversely, if the harp needs to be repaired, the foregoing components may be readily disassembled by first disassembling the truss rods from the truss plate. This removes the clamping load applied between the cap 52 and base 54 by the truss rods. Thereafter, the base can be readily removed from the soundbox 10 and the soundbox 10 from the cap 52. Also, the neck and pillar may then be disassembled.

The truss rods 64A and 64B also serve to counter the force applied to the harp components by the tensioned strings 50. It will be appreciated that when the strings 50 are fully tensioned, they collectively impose hundreds of pounds of load on the soundboard 48 and thus the soundbox 10. The tension on the strings 50 applies an upward shear load on the soundboard 48 as well as a downward compression load on the pillar 13. Also, a compression load is applied to the neck 50. The sum total of these loads places a significant bending load on the base 54. However, the truss rods 64A and 64B redirect the downward compression load of the pillar 13 back up to the cap 52 or neck 15, thereby to counteract the load on the base from the pillar. As a result, a more stable harp structure is achieved than if the truss rods 64A and 64B were not used.

It will be appreciated that although two truss rods 64A and 64B are illustrated, the present invention could utilize a singular truss rod, perhaps the same size or a different size than truss rods 64A and 64B. Moreover, more than two truss rods may be utilized in appropriate circumstances. Whether one, three or more truss rods are utilized, such truss rods would provide the same function and benefits as provided by truss rods 64A, 64B, as described.

Referring to FIG. 8, side blocks 74A and 74B may be used to engage the upper surface of the base 72 and the interior side surface of the soundbox 70. The blocks 74A and 74B help secure and reinforce the base 54 to the soundbox 10. The blocks 74A and 74B can fit within the L-shaped groove horizontal portions 36A and 36B. A cross-sectional view of the blocks 74A and 74B fitting within the horizontal portion of the L-shaped grooves 36A and 36B is shown in FIG. 7. The blocks 74A and 74B may be positioned in registry with the horizontal portion of the L-shaped grooves 36A and 36B. Additionally, the blocks 74A and 74B may be secured to the base 54 through fasteners, such as nails or screws, or an adhesive, such as glue. In this manner, the blocks help secure the base 54 to the bottom of the soundbox.

Although the soundbox 10 is illustrated and described as being generally frustro rectilinear in shape by virtue of the width of the soundbox at the base being wider than the width of the soundbox at cap 52, it will be appreciated that the soundbox can be formed in a generally right rectangular shape. As such, the outer faces or sides of the segments 33 of panels 14-14A may be parallel to each other and generally transverse to, the upper edge 18 and to the lower edge 20. Also, the soundboard may be parallel to the back of the soundbox. Such structure could somewhat simplify the construction of the soundbox 10.

Furthermore, panel 14 and the soundboard 48 can be constructed from an integral panel. In this regard, the soundboard can be disposed along either edge 16A or 16B of the panel 14 of FIG. 2A. A groove can be formed between the soundbox segment of the panel and the remaining portion of the panel to allow the soundboard portion to be folded over and span across the soundbox to the opposite edge of a soundbox. Such an integral construction of the soundbox 10 can provide significant advantages in terms of cost, manufacture and assembly of the present invention.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A soundbox assembly for a stringed musical instrument called a harp, comprising:

a three-dimensional subassembly forming the soundbox, a soundboard disposed within the three-dimensional assembly, and a load imposed on the subassembly during use of the harp;

a base removably disposed at one end portion of the three-dimensional subassembly;

a cap removably disposed at the opposite end portion of the three-dimensional subassembly;

a neck extending outward from the cap to intersect one end of a pillar, the pillar extending to the base; and at least one tension truss having first and second ends, the first end of the tension truss releasably secured to the base and the second end of the tension truss releasably secured to the cap, the tension truss disposed within the interior of the soundbox in a spaced relationship from the soundboard and physically isolated from structural components disposed within the interior of the soundbox, said tension truss being loaded in tension during use of the harp thereby to enhance the structural integrity of the soundbox.

2. The soundbox subassembly according to claim 1, wherein the load imposed on the three-dimensional subassembly during use of the harp is applied by strings which are manipulated during the playing of the harp.

3. The soundbox assembly according to claim 1, wherein said subassembly being nominally in the form of a panel and a plurality of grooves formed along the length of the panel, said panel being folded about said grooves to form the three-dimensional shape of the subassembly.

4. The soundbox assembly according to claim 1, wherein:

the tension truss extending from the base to the cap to impose forces on the first end structure and the second end structure in a direction towards each other thereby to maintain the base, three-dimensional subassembly, cap, neck and pillar in assembled relationship to each other.

5. The soundbox assembly according to claim 4, wherein the pillar exerts a downward compressive load on the base and the tension truss redirects the downward compressive load to the cap or the neck.

6. A method of manufacturing and assembling a soundbox for a stringed musical instrument called a harp, the method comprising:

(a) forming an enclosed shaped subassembly comprising the distal and sidewalls of the soundbox, the subassembly adapted to removably receive a cap on a first end of the subassembly and removably receive a base on a second end of the subassembly;

(b) positioning a soundboard to span the two sidewalls;

(c) positioning said cap on the first end of the subassembly, wherein a neck extends outward from the cap to intersect one end of a pillar;

(d) positioning at least one tension truss within the enclosed shaped subassembly such that the tension truss is physically isolated from the subassembly, the soundboard, and structural components disposed within the subassembly;

(e) releasably mounting a first end of the at least one longitudinal truss member to the base, wherein the pillar extends toward the base; and (f) releasably mounting a second end of the at least one longitudinal truss member to the cap to press the cap against the first end of the subassembly and to press the base against the second end of the subassembly, thereby forming the soundbox.

7. The method of claim 6, wherein the pillar exerts a downward compressive load on the base and the longitudinal truss member redirects the downward compressive load to the cap or the neck.

8. The method of claim 6, further comprising forming a plurality of grooves on an interior surface of a first member and folding the first member along the plurality of grooves to form the enclosed shaped subassembly.

9. The method of claim 8, wherein the soundboard is integrally constructed with the first member.

10. The method of claim 8, further comprising:

forming a plurality of grooves along opposed peripheral edge portions of the first member, said plurality of grooves formed of a depth corresponding to a majority of the thickness of the first member; and folding the first member edges along the longitudinal grooves to form a rolled edge.

* * * * *